US009303925B2

(12) United States Patent
Zhang et al.

(10) Patent No.: US 9,303,925 B2
(45) Date of Patent: Apr. 5, 2016

(54) MICROCHANNEL SUCTION LINE HEAT EXCHANGER

(75) Inventors: Ming Zhang, Ballwin, MO (US); Ken Nguyen, St. Louis, MO (US)

(73) Assignee: Hussmann Corporation, Bridgeton, MO (US)

( * ) Notice: Subject to any disclaimer, the term of this patent is extended or adjusted under 35 U.S.C. 154(b) by 252 days.

(21) Appl. No.: 13/399,511

(22) Filed: Feb. 17, 2012

(65) Prior Publication Data

US 2013/0213081 A1 Aug. 22, 2013

(51) Int. Cl.

| | |
|---|---|
| ***F25B 1/00*** | (2006.01) |
| ***F28F 9/02*** | (2006.01) |
| ***F28D 7/16*** | (2006.01) |
| ***F28F 1/02*** | (2006.01) |
| ***F25B 40/00*** | (2006.01) |

(52) U.S. Cl.

CPC ..... *F28D 7/1684* (2013.01); *F25B 40/00* (2013.01); *F28F 1/022* (2013.01); *F28F 9/02* (2013.01); *F28F 2255/16* (2013.01)

(58) Field of Classification Search

CPC ..... F28D 7/0008; F28D 7/0025; F28F 1/40; F28F 9/0217; F28F 9/0229

USPC ..... 165/172, 173, 175, 176, 177, 164, 70; 62/513

See application file for complete search history.

(56) References Cited

U.S. PATENT DOCUMENTS 2,757,628 A * 8/1956 Johnston ..... 29/890.047
3,306,353 A * 2/1967 Burne ..... 165/164
3,415,316 A * 12/1968 Burne et al. ..... 165/164
3,439,739 A * 4/1969 Jaeger ..... 165/164
3,508,606 A * 4/1970 Anderson ..... F28D 7/1669 165/145

(Continued)

FOREIGN PATENT DOCUMENTS

| | | |
|---|---|---|
| WO | 2006074353 | 7/2006 |
| WO | 2009017832 | 2/2009 |

OTHER PUBLICATIONS

Kandlikar, Satish G. and Grande, William J., "Evolution of Microchannels Flow Passages—Thermohydraulic Performance and Fabrication Technology", Proceedings of IMECE2002, ASME International Mechanical Engineering Congress and Exposition, IMECE2002-32043, New Orleans, Louisiana, Nov. 17-22, 2002.*

(Continued)

*Primary Examiner* — Ljiljana Ciric
*Assistant Examiner* — Kirstin Oswald
(74) *Attorney, Agent, or Firm* — Michael Best & Friedrich LLP

(57) ABSTRACT

A refrigeration system including a refrigeration circuit that has an evaporator, a compressor, a condenser, and a heat exchanger. The evaporator, compressor, and condenser are fluidly connected and arranged in series with each other. A liquid line fluidly connects the evaporator to the condenser and a suction line fluidly connects the compressor to the evaporator. The heat exchanger includes a plurality of first refrigerant flow tubes that is in fluid communication with one of the suction line and the liquid line, and a second refrigerant flow tube that is in fluid communication with the other of the suction line and the liquid line. Each of the first refrigerant flow tubes and the second refrigerant flow tube have microchannels, and the second refrigerant flow tube positioned between and cooperates with the first refrigerant flow tubes to heat vapor refrigerant flowing in the suction line.

16 Claims, 6 Drawing Sheets

(56) References Cited

U.S. PATENT DOCUMENTS 3,595,310 A * 7/1971 Burne et al. ..... 165/161
3,759,319 A * 9/1973 Ritland ..... F22B 37/266 122/483
4,121,656 A * 10/1978 Huber ..... F28F 9/0212 165/110
4,186,495 A * 2/1980 Remberg ..... B01D 5/0006 165/140
4,858,681 A * 8/1989 Sulzberger ..... 165/70
5,031,693 A * 7/1991 VanDyke ..... F28F 3/027 165/166
5,453,641 A 9/1995 Mundinger et al.
5,582,015 A 12/1996 Davidson
5,765,393 A 6/1998 Shlak et al.
5,979,051 A * 11/1999 Kato et al. ..... 29/890.049
6,126,723 A 10/2000 Drost et al.
6,364,007 B1 * 4/2002 Fischer ..... 165/166
6,741,469 B1 5/2004 Monfarad
6,869,462 B2 3/2005 TeGrotenhuis et al.
6,926,069 B1 * 8/2005 Roffelsen ..... 165/70
6,976,527 B2 12/2005 Kirshberg et al.
6,994,151 B2 2/2006 Zhou et al.
7,000,427 B2 2/2006 Mathias et al.
7,051,796 B2 * 5/2006 Kamiyama ..... F28D 1/0443 165/140
7,059,397 B2 * 6/2006 Chatel ..... F28F 3/027 165/164
7,188,484 B2 3/2007 Kim
7,261,151 B2 8/2007 Memory et al.
7,302,807 B2 12/2007 Yakumaru et al.
7,334,630 B2 2/2008 Goodson et al.
7,404,936 B2 7/2008 Mazanec et al.
7,610,775 B2 11/2009 Tonkovich et al.
7,661,460 B1 * 2/2010 Cowans et al. ..... 165/64
2004/0079521 A1 * 4/2004 Torigoe ..... F28D 1/0246 165/166
2005/0178525 A1 * 8/2005 Pierce ..... F28D 1/05333 165/79
2005/0199381 A1 * 9/2005 Mercz ..... F02M 25/0729 165/172
2006/0042274 A1 3/2006 Manole
2006/0231233 A1 10/2006 Farid et al.
2007/0131403 A1 6/2007 Vetrovec et al.
2007/0181294 A1 * 8/2007 Soldner ..... F02M 25/0734 165/175
2008/0078198 A1 * 4/2008 Breiding ..... F28B 9/08 62/324.5
2008/0105420 A1 5/2008 Taras et al.
2009/0326279 A1 12/2009 Tonkovich et al.
2010/0012305 A1 1/2010 Taras et al.
2010/0139313 A1 * 6/2010 Taras ..... 62/498
2010/0181053 A1 * 7/2010 Hecht ..... F28D 9/0068 165/164

OTHER PUBLICATIONS

U.S. Department of Energy, Microtube Strip Heat Exchanger, project fact sheet, Nov. 1999, 2 pages.

Anna Lee Tonkovich, PhD, Microchannel Heat Exchangers: Applications and Limitations, presentation, Dec. 5, 2007, 47 pages.

* cited by examiner

MICROCHANNEL SUCTION LINE HEAT EXCHANGER

BACKGROUND

The present invention relates to a suction line heat exchanger, and more particularly, to a microchannel suction line heat exchanger for use in a refrigeration circuit.

The primary components of a typical refrigeration circuit include a compressor, a condenser, an expansion valve, and an evaporator. The evaporator receives a vapor refrigerant from the expansion valve and subjects the refrigerant to a medium to be cooled (e.g., an airflow). The thermodynamic state of the refrigerant exiting the evaporator is typically very near a saturated vapor but often contains a small amount of liquid refrigerant, which if introduced into the compressor may impair compressor operation and permanently damage the compressor.

Some refrigeration circuits braze the liquid tube upstream of the evaporator to the suction tube downstream of the evaporator to form a suction line heat exchanger. Other refrigeration circuits include tube-in-tube heat exchangers. However, these existing suction line heat exchangers suffer from very low effectiveness while entailing relatively high material and labor costs and taking up a substantial amount of space.

SUMMARY

In one construction, the invention provides a refrigeration system including a refrigeration circuit that has an evaporator, a compressor, and a condenser that are fluidly connected and arranged in series with each other. A liquid line fluidly connects the evaporator to the condenser and a suction line fluidly connects the compressor to the evaporator. The refrigeration system also includes a heat exchanger that has a plurality of first refrigerant flow tubes that is in fluid communication with one of the suction line and the liquid line, and a second refrigerant flow tube that is in fluid communication with the other of the suction line and the liquid line. Each of the first refrigerant flow tubes and the second refrigerant flow tube have microchannels, and the second refrigerant flow tube positioned between and cooperates with the first refrigerant flow tubes to heat vapor refrigerant flowing in the suction line.

In another construction, the invention provides a refrigeration system including a refrigeration circuit that has an evaporator, a compressor, and a condenser that are fluidly connected and arranged in series with each other. A liquid line fluidly connects the evaporator to the condenser and a suction line fluidly connects the compressor to the evaporator. The refrigeration system also includes a heat exchanger that has a plurality of vapor refrigerant tubes in fluid communication with and receiving vapor refrigerant from the evaporator, and a liquid refrigerant tube sandwiched between the vapor refrigerant tubes and receiving liquid refrigerant from another portion of the refrigerant circuit. The heat exchanger further includes a first header positioned adjacent one end of the vapor refrigerant tubes and the liquid refrigerant tube, and a second header positioned adjacent the other end of the vapor refrigerant tubes and the liquid refrigerant tube to receive vapor refrigerant and liquid refrigerant adjacent both ends of the vapor and liquid refrigerant tubes.

In another construction, the invention provides a heat exchanger including an elongated body that defines an axis and that has a first end and a second end. The heat exchanger also includes first refrigerant flow tubes that define microchannels extending between the first end and the second end, and a second refrigerant flow tube that defines microchannels extending between the first end and the second end and at least partially positioned between the first refrigerant flow tubes. One of the first refrigerant flow tubes and the second refrigerant flow tube receives vapor refrigerant from an evaporator, and the other of the first refrigerant flow tubes and the second refrigerant flow tube receives liquid refrigerant from a source other than the evaporator. The heat exchanger also includes a header in fluid communication with the first refrigerant flow tubes and the second refrigerant flow tube. The header defines a vapor header section to receive vapor refrigerant and a liquid header section to receive liquid refrigerant such that vapor and liquid refrigerant flow through the heat exchanger in one of a counterflow and a unidirectional flow arrangement.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
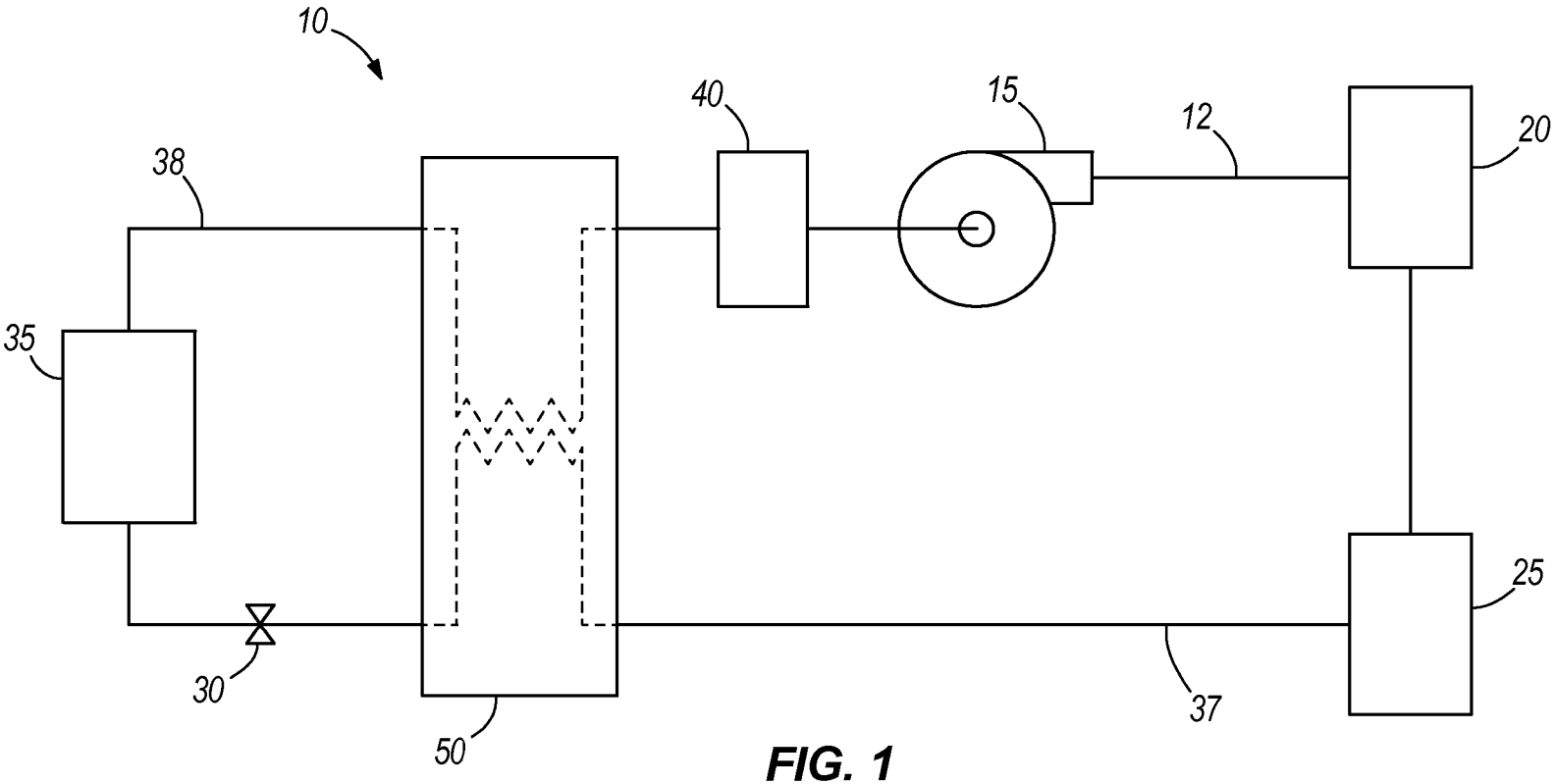
FIG. 1 is a schematic of a refrigeration system including a circuit that has a suction line heat exchanger embodying the present invention.

FIG. 1 shows a refrigeration system 10 including a refrigeration circuit 12 for use with refrigerated display cases or heating, ventilation, and air conditioning and refrigeration systems (not shown). The refrigeration circuit 10 includes a compressor 15 that discharges gaseous refrigerant to a condenser 20, which cools refrigerant via heat exchange with air or another medium flowing through the condenser 20.

The refrigeration circuit 10 also includes a receiver 25 located downstream of the condenser 20 to accumulate and store liquid refrigerant and an expansion valve 30 downstream of the receiver 25. An evaporator 35 receives refrigerant from the receiver 25 via a liquid line 37 and cools a medium (e.g., an airflow through a refrigerated display case) via heat exchange between refrigerant flowing through the evaporator 35 and the medium. The compressor 15 is fluidly connected to the evaporator by a suction line 38. An accumulator 40 may be disposed upstream of the compressor 15 and downstream of the evaporator 35 to store any liquid refrigerant not vaporized in the evaporator 35 and to deliver gaseous refrigerant to the compressor 15. As one of ordinary skill in the art will appreciate, the refrigeration circuit 10 can include other components depending on the desired characteristics of the refrigeration circuit 10 and the conditioning needs for which the refrigeration circuit 10 is being used.

FIG. 1 shows that the refrigeration circuit 10 also includes a suction line heat exchanger 50 located between and in fluid communication with the compressor 15 and the evaporator to transfer energy from liquid refrigerant at a point in the circuit 10 prior to the expansion valve 30 to refrigerant exiting the evaporator 35. While the heat exchanger 50 is described with regard to the refrigeration circuit 10, one of ordinary skill will appreciate the heat exchanger 50 can be used in other liquid-vapor heat transfer applications. Generally, the heat exchanger 50 is constructed of a thermally conductive material, such as a metal (e.g., aluminum).

Figure 2:
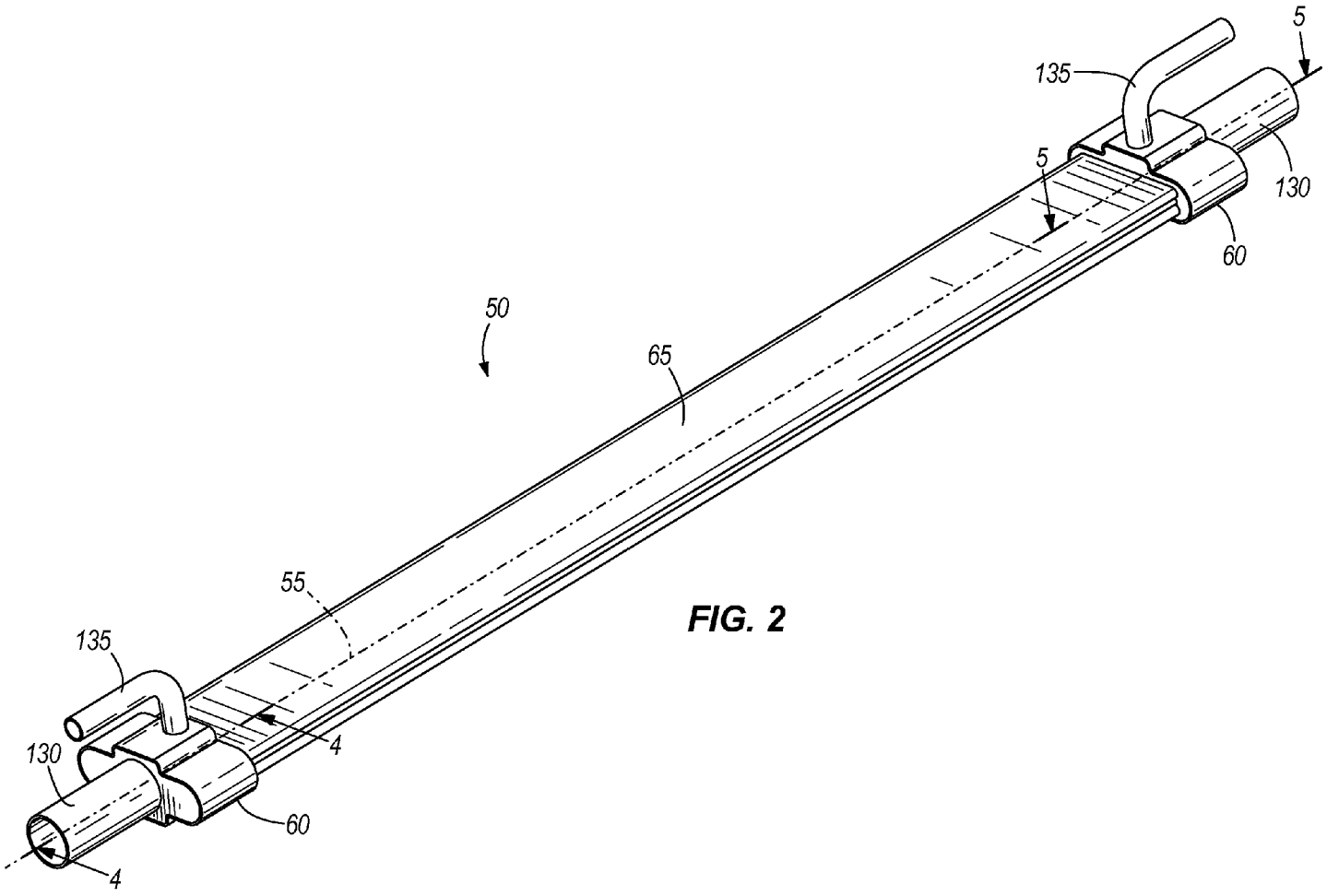
FIG. 2 is a perspective view of the heat exchanger including headers and microchannel tubes extending between the headers.
Figure 3:
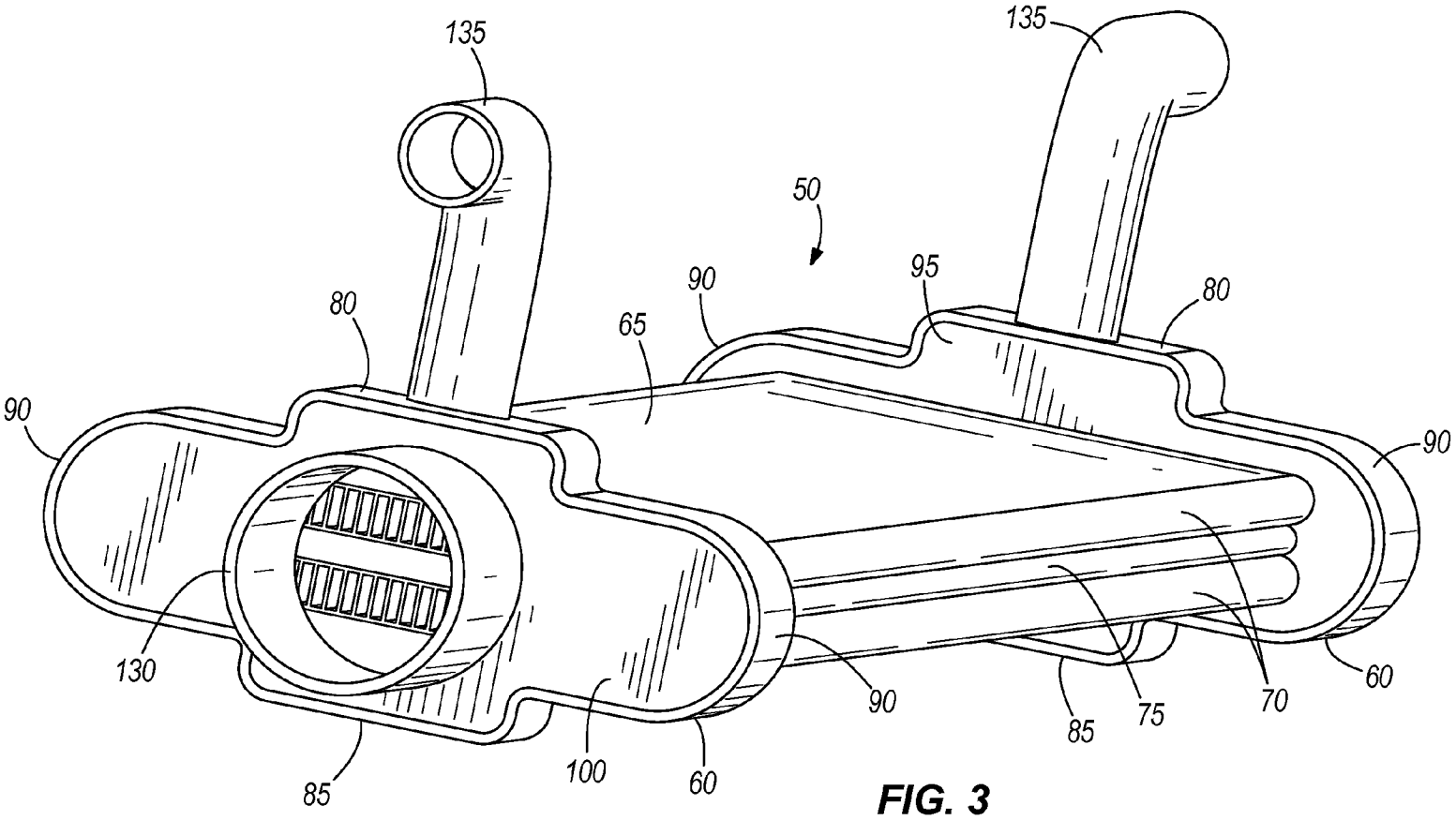
FIG. 3 is another perspective view of the heat exchanger of FIG. 2.
Figure 4:
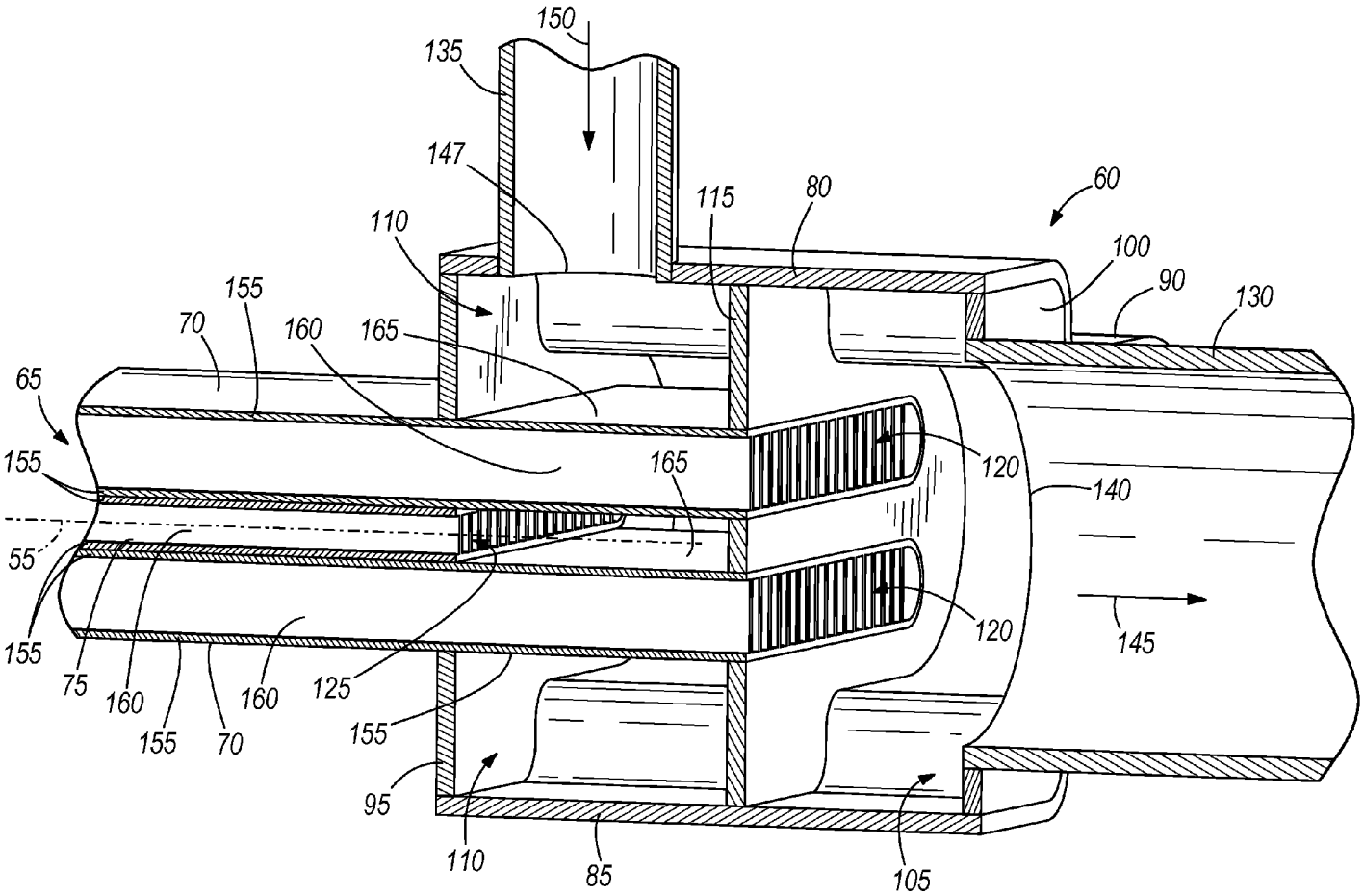
FIG. 4 is section view of a portion of the heat exchanger of FIG. 2.

As illustrated in FIGS. 2-4, the heat exchanger 50 is defined by an elongated body that has a first end and a second end. An axis 55 extends through the heat exchanger between the first end and the second end. The heat exchanger includes two headers 60 and a tube section 65 that has two microchannel vapor refrigerant flow tubes 70 and a single microchannel liquid refrigerant flow tube 75 extending between the headers 60. With reference to FIG. 4, each header 60 is disposed on an end of the elongated body and forms a compartment or refrigerant collection area. The headers 60 fluidly connect the tube section 65 to the refrigeration circuit 10.

Specifically, each illustrated header 60 is defined by a top wall 80, a bottom wall 85, side walls 90 extending between the top and bottom walls 80, 85 (as viewed in FIGS. 3-5), an inner end wall 95, and an outer end wall 100 (relative to the nearest end of the heat exchanger 50). The terms "bottom," "top," and "side" used in describing the headers 60 are merely for reference purposes relative to the illustrated heat exchanger 50 and is not meant to be limiting. As illustrated in FIGS. 2-5, the headers 60 are identical in structure, only one of which will be described in detail below.

Figure 5:
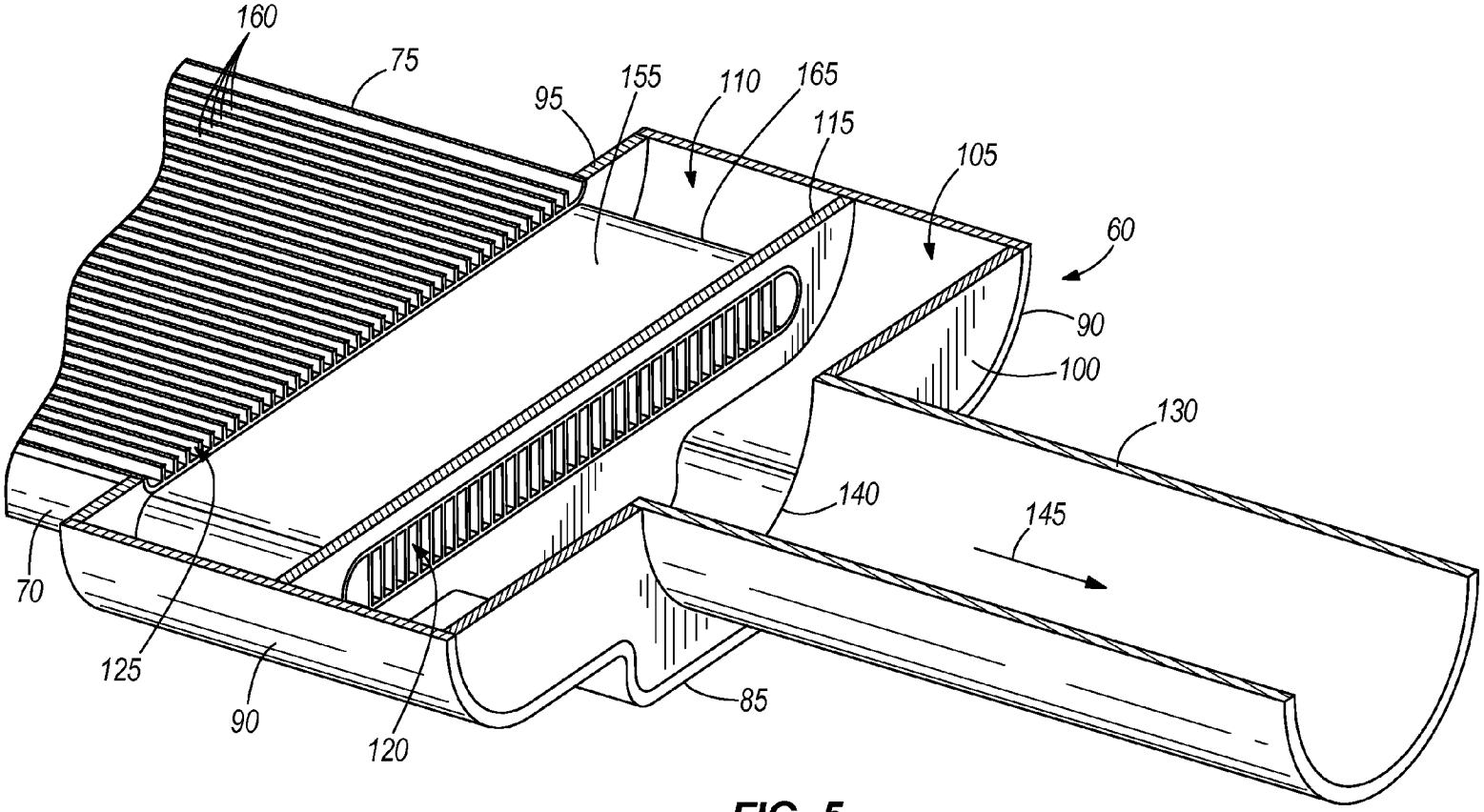
FIG. 5 is another section view of a portion of the heat exchanger of FIG. 2.

With reference to FIGS. 3-5, each header 60 defines a vapor header section 105 and a liquid header section 110 separated from the vapor header section 105 by a partition 115. As shown in FIGS. 2 and 4, the vapor header section 105 and the liquid header section 110 are axially aligned along the axis 55. The vapor header section 105 is bounded by the top wall 80, the bottom wall 85, the side walls 90, the outer end wall 100, and the partition 115. As shown in FIG. 4, the vapor tubes 70 are in fluid communication with the vapor header section 105 and terminate in a plurality of openings 120 at the partition 115. As discussed in detail below, vapor refrigerant is received in the vapor header section 105 flowing to or from the vapor tubes 70.

The liquid header section 110 is bounded by the top wall 80, the bottom wall 85, the side walls 90, the inner end wall 95, and the partition 115. As shown in FIG. 4, the liquid tube 75 is in fluid communication with the liquid header section 110 and terminates in a plurality of openings 125 at the inner end wall 95. As discussed in detail below, liquid refrigerant is received in the liquid header section 110 flowing to or from the liquid tube 75.

FIGS. 2-4 show that the headers 60 include vapor ports 130 that are in fluid communication with the vapor tubes 70, and liquid ports 135 that are in fluid communication with the liquid tube 75. The vapor port 130 of one header 60 defines an entrance for vapor refrigerant to the heat exchanger 50, whereas the vapor port 130 of the other header 60 defines an exit for vapor refrigerant from the heat exchanger 50. As shown in FIGS. 4 and 5, the outer end wall 100 has an aperture 140 to allow refrigerant flow between the vapor header section 105 and the vapor port 130. An arrow 145 indicates the direction of vapor flow through the heat exchanger 50 toward the compressor 15 (see FIG. 1). Although the vapor port 130 is illustrated on ends of the heat exchanger 50, the vapor port 130 can be located in any suitable location that is in communication with the vapor header section 105.

The liquid port 135 of one header 60 defines an entrance for liquid refrigerant to the heat exchanger 50, and the liquid port 135 of the other header 60 defines an exit for liquid refrigerant from the heat exchanger 50. The top wall 80 includes an aperture 147 to allow refrigerant flow between the liquid header section 110 and the liquid port 135. As shown in FIG. 4, an arrow 150 indicates the direction of liquid flow through the heat exchanger 50 from the condenser 20. The liquid port 135 may be located at any convenient location on the heat exchanger 50. Also, the heat exchanger 50 can include another liquid port 135, for example, extending through the bottom wall 85.

Figure 6:
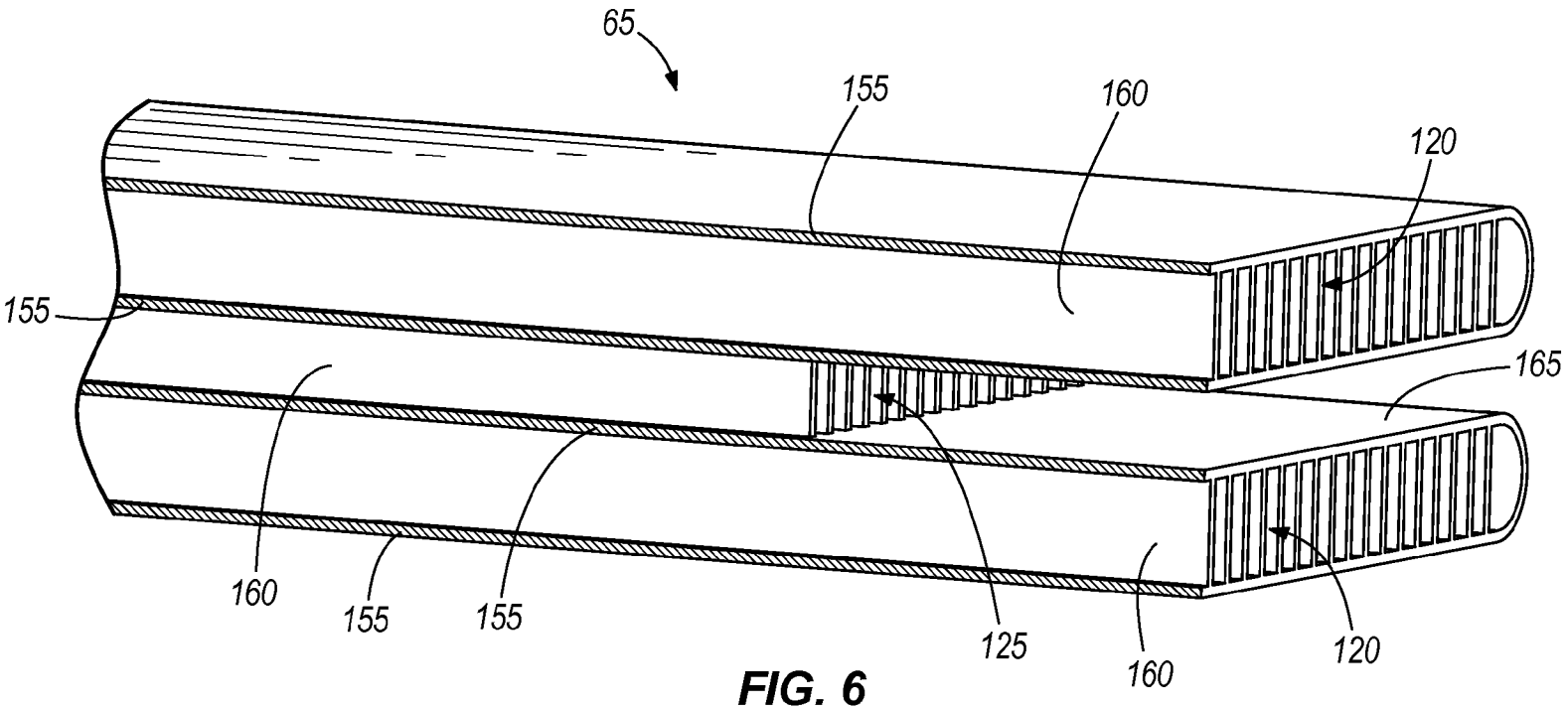
FIG. 6 is a perspective view of a portion of the heat exchanger including first and second refrigerant tubes.

With reference to FIG. 3, the illustrated tube section 65 has two vapor microchannel tubes 70 and one liquid microchannel tube 75 sandwiched between the vapor tubes 70, although the tube section 65 can have other 'sandwiched' configurations with fewer or more than two vapor tubes 70 and one liquid tube 75. The vapor and liquid tubes 70, 75 have exterior walls 155 that are joined together (e.g., by brazing, welding, etc.) in a lengthwise direction along the axis 55. As illustrated in FIG. 6, the tube section 65 may be formed as a single extruded tube section 65 separated into vapor and liquid tubes 70, 75 that share exterior walls 155 to minimize the material separating the vapor and liquid tubes 75.

Generally, each of the microchannel vapor and liquid tubes 70, 75 has a plurality of relatively small internal channels 160 that transfer heat between the liquid and vapor refrigerant in the respective tubes. As will be understood by one of ordinary skill in the art, the microchannels 160 define multiple internal passageways through the tubes 70, 75 that are smaller in size than the internal passageway of a coil in a conventional fin-and-tube evaporator. As illustrated, the microchannels 160 are defined by a rectangular cross-section, although other cross-sectional shapes are possible and considered herein. For example, each microchannel 160 of the illustrated tubes 70, 75 has a width of approximately 1.5 mm and a height of approximately 6 mm. In other constructions, the microchannels 160 may be smaller or larger depending on desired heat transfer characteristics for the heat exchanger 50. Thus, the quantity of microchannels 160 within each tube 70, 75 will depend on the width of the corresponding tube 70, 75 and the size of each microchannel.

Due to the flattened profile of each tube section 65, the tubes 70, 75 include one row of microchannels 160 spaced laterally across the width the tubes 70, 75, although other constructions of the heat exchanger 50 can include two or more rows of microchannels 160. The vapor and liquid tubes 70, 75 can be sized to accommodate the heat transfer requirements of the application for which the heat exchanger 50 is used. The precise length, width, and quantity of microchannels 160 are a function of the amount of refrigerant needed for the particular application to maximize heat transfer between the tubes 70, 75 while minimizing system refrigerant pressure drop. The microchannels 160 are fluidly coupled to and extend between the vapor and liquid header sections 105, 110.

As shown in FIG. 4, the liquid tube 75 is shorter than the adjacent vapor tubes 70 such that end portions 165 of each vapor tube 70 are in direct communication with refrigerant in the liquid header section 110. The exterior walls 155 of the end portions 165 provide direct heat transfer between vapor refrigerant flowing through the vapor tubes 70 and liquid refrigerant exiting or entering the liquid tube 75 as refrigerant flows within the liquid header section 110. In other constructions, the liquid tube 75 can be the same length or longer than the vapor tubes 70 depending on desired heat transfer characteristics.

The illustrated heat exchanger 50 provides a longitudinal counterflow arrangement with respect to liquid refrigerant entering the heat exchanger 50 from the condenser 20 and vapor refrigerant entering the heat exchanger 50 from the evaporator 35. Alternatively, vapor refrigerant and liquid refrigerant can flow in the same direction in a parallel flow arrangement through the heat exchanger 50, depending on the desired heat transfer characteristics within the heat exchanger 50. As illustrated, the vapor header 60 and the liquid header 60 of each header 60 provide an efficient use of space, enhanced heat transfer, and system connection flexibility.

Generally, liquid refrigerant entering the liquid header 60 is in a subcooled state and is further subcooled upon exiting the liquid tube 75 by heat exchange with the vapor refrigerant in the adjacent vapor tubes 70. The partition 115 separates the vapor header section 105 from the liquid header section 110 so that vapor and liquid refrigerant do not commingle in the headers 60. The vapor header section 105 is in fluid communication with the vapor tubes 70 and receives vapor refrigerant flowing to or from the vapor tubes 70. The liquid header section 110 is in fluid communication with the liquid tube 75 and receives liquid flowing to or from the liquid tube 75.

In counterflow operation of the heat exchanger 50, condensed liquid refrigerant from the condenser 20 enters the liquid port 135 of one of the headers 60, flows through the adjacent liquid header section 110, and enters the openings 125 of the liquid tube 75. Vapor refrigerant from the evaporator 35 enters the vapor port 130 of the other header 60, flows through the adjacent vapor header section 105, and enters the openings 120 of the vapor tubes 70. As a result, vapor refrigerant in the vapor tubes 70 is heated via heat transfer from the warmer liquid refrigerant flowing within the sandwiched liquid tube 75. Subcooled liquid refrigerant exits the liquid tube 75 at the opposite openings 125, flows through the adjacent liquid header section 110, and out the liquid port 135 to the expansion valve 30. Heated (e.g., superheated) vapor refrigerant exits the vapor tubes 70 at the opposite openings 120, flows through the adjacent vapor header section 110, and out the vapor port 130 to the compressor 15.

Parallel, unidirectional flow operation of the heat exchanger 50 is similar to counterflow operation, except that vapor refrigerant and liquid refrigerant flow through the tube section 65 in the same direction. Specifically, in parallel, unidirectional flow operation of the heat exchanger 50, condensed liquid refrigerant from the condenser 20 enters the liquid port 135 of one of the headers 60, flows through the adjacent liquid header section 110, and enters the openings 125 of the liquid tube 75. Vapor refrigerant from the evaporator 35 enters the vapor port 130 of the same header 60, flows through the adjacent vapor header section 105, and enters the openings 120 of the vapor tubes 70. Like counterflow operation, vapor refrigerant in the vapor tubes 70 is heated by heat exchange with liquid refrigerant flowing within the sandwiched liquid tube 75. Heated vapor and subcooled liquid refrigerant exits the tube section 65 through respective openings 120, 125 in the same header 60. Vapor refrigerant then flows through the vapor header section 105 and out the vapor port 130 to the compressor 15, and liquid refrigerant flows through the adjacent liquid header section 110 and out the liquid port 135 to the expansion valve 30.

The microchannel vapor and liquid tubes 70, 75 of the heat exchanger 50, whether used in a counterflow or parallel unidirectional flow setup, maximize the heat transfer surface between the tubes 70, 75 while minimizing the size of the heat exchanger 50. In this manner, the cooling capacity of the refrigeration circuit 10 is higher relative to conventional circuits while reducing the power needed to operate the circuit.

Various features and advantages of the invention are set forth in the following claims.

The invention claimed is:

1. A heat exchanger comprising:

an elongated body defining a longitudinal axis and having a first end and a second end;

first refrigerant flow tubes extending parallel to the longitudinal axis, each of the first refrigerant flow tubes having a plurality of microchannels extending between the first end and the second end, the microchannels defining separate internal passageways in thermal communication with each other within the first refrigerant flow tubes;

a second refrigerant flow tube extending parallel to the longitudinal axis having a plurality of microchannels extending between the first end and the second end and at least partially positioned between the first refrigerant flow tubes, the microchannels defining separate internal passageways in thermal communication with each other within the second refrigerant flow tube, one of the first refrigerant flow tubes and the second refrigerant flow tube configured to receive vapor refrigerant from an evaporator, and the other of the first refrigerant flow tubes and the second refrigerant flow tube configured to receive liquid refrigerant from a source other than the evaporator; and a header in fluid communication with the first refrigerant flow tubes and the second refrigerant flow tube, the header defining a vapor header section to receive vapor refrigerant and a liquid header section to receive liquid refrigerant such that vapor and liquid refrigerant flow through the heat exchanger in one of a counterflow and a unidirectional flow arrangement, wherein the first refrigerant flow tubes extend into the header such that refrigerant directed to or exiting the second refrigerant flow tube flows around a portion of at least one of the first refrigerant flow tubes.

2. The heat exchanger of claim 1, wherein a portion of one of the first refrigerant flow tubes and the second refrigerant flow tube is in direct thermal communication with liquid refrigerant in the liquid header section.

3. The heat exchanger of claim 2, wherein the microchannels of the first refrigerant flow tubes terminate in openings adjacent the first end and the second end, and wherein the second refrigerant flow tube is shorter than both of the first refrigerant flow tubes such that openings to the microchannels of the second refrigerant flow tube are spaced longitudinally inward from the openings of the first refrigerant flow tubes.

4. The heat exchanger of claim 1, wherein the vapor header section and the liquid header section are separated from each other and are axially aligned along the axis.

5. The heat exchanger of claim 1, wherein the header is a first header positioned adjacent the first end, the heat exchanger further comprising a second header positioned adjacent the second end, and wherein the second header is in fluid communication with the first refrigerant flow tubes and the second refrigerant flow tube, and defines a second vapor header section and a second liquid header section.

6. The heat exchanger of claim 5, wherein the first refrigerant flow tubes and the second refrigerant flow tube provide a counterflow arrangement such that the first header is configured to receive vapor refrigerant prior to entry into one of the first refrigerant flow tubes and the second refrigerant flow tube and the second header is configured to receive liquid refrigerant prior to entry into the other of the first refrigerant flow tubes and the second refrigerant flow tube.

7. The heat exchanger of claim 5, wherein the first refrigerant flow tubes are in fluid communication with the vapor header sections and the second refrigerant flow tube is in fluid communication with the liquid header sections.

8. The heat exchanger of claim 5. wherein each of the first header and the second header defines a liquid refrigerant port that is oriented at a non-zero angle relative to the axis to direct liquid refrigerant to and from the respective liquid header sections, and wherein each of the first header and the second header defines a vapor refrigerant port that is oriented along the longitudinal axis.

9. The heat exchanger of claim 8, wherein the liquid refrigerant port of the first header and the liquid refrigerant port of the second header are oriented perpendicular to the longitudinal axis.

10. The heat exchanger of claim 1, wherein the first refrigerant flow tubes and the second refrigerant flow tube are formed by extrusion.

11. The heat exchanger of claim 1, wherein the header includes longitudinally-spaced end walls and a partition positioned between the end walls, wherein the partition separates the vapor header section and the liquid header section, and wherein the first refrigerant flow tubes terminate at the partition.

12. The heat exchanger of claim 11, wherein the second refrigerant flow tube terminates at one of the end walls.

13. The heat exchanger of claim 11, wherein the vapor header section is at least partially bounded by one of the end walls and the partition.

14. The heat exchanger of claim 13, wherein the liquid header section is at least partially bounded by the other of the end walls and the partition.

15. The heat exchanger of claim 1, wherein the second refrigerant flow tube is sandwiched by the first refrigerant flow tubes.

16. The heat exchanger of claim 1, wherein the liquid header section and the vapor header section are separated by a partition, and wherein the microchannels of the first refrigerant flow tubes or the microchannels of the second refrigerant flow tube extend through the partition.

* * * * *